US006305403B1

(12) United States Patent
von Palffy et al.

(10) Patent No.: US 6,305,403 B1
(45) **Date of Patent: *Oct. 23, 2001**

(54) AERATION APPARATUS FOR A VERTICAL RISER IN A VACUUM DRAINAGE SYSTEM

(75) Inventors: Bjorn von Palffy, South Beloit; Douglas M. Wallace; Jay D. Stradinger, both of Roscoe, all of IL (US)

(73) Assignee: Evac International Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/397,230

(22) Filed: Sep. 16, 1999

(51) Int. Cl.[7] ..... F04F 3/00
(52) U.S. Cl. ..... 137/205; 137/236.1
(58) Field of Search ..... 137/205, 236.1

(56) References Cited

U.S. PATENT DOCUMENTS

| | | | | |
|---|---|---|---|---|
| 3,853,138 | * | 12/1974 | Amren | 137/205 X |
| 4,209,034 | | 6/1980 | Michael | 137/236 R |
| 4,285,359 | | 8/1981 | Doherty | 137/205 |
| 4,333,487 | | 6/1982 | Michael | 137/2 |
| 4,333,830 | | 6/1982 | Michael | 210/170 |
| 4,370,227 | | 1/1983 | Michael | 210/170 |
| 4,603,709 | | 8/1986 | Huisma | 137/205 |
| 4,791,949 | | 12/1988 | Tank | 137/1 |
| 5,575,304 | * | 11/1996 | Hassett | 137/205 X |
| 5,673,723 | * | 10/1997 | Roediger | 137/205 |

FOREIGN PATENT DOCUMENTS 1 579 389 11/1980 (GB) .

* cited by examiner

*Primary Examiner*—Gerald A. Michalsky
(74) *Attorney, Agent, or Firm*—Marshall, Gerstein & Borun

(57) ABSTRACT

A vacuum drainage system having a vertical riser with an aeration point. The aeration point prevents stalls in the vacuum drainage system by breaking up the formation of a solid fluid column in the riser. In certain applications, the aeration point allows the vacuum drainage system to operate in a deliberately flooded condition by regulating air flow into the riser. The aeration point may be provided simply as a hole positions at an optimum height above a bottom of the riser, or it may include apparatus for retaining fluid inside the riser, such as a check valve. In addition, the aeration point may be provided with an automatically adjustable cross-section, so that aeration point is quickly and easily adapted to changing operating parameters in the vacuum drainage system.

13 Claims, 3 Drawing Sheets

AERATION APPARATUS FOR A VERTICAL RISER IN A VACUUM DRAINAGE SYSTEM

FIELD OF THE INVENTION

The present invention generally relates to fluid drains, and more particularly to vacuum drainage systems.

BACKGROUND OF THE INVENTION

Various types of drainage systems are used to transport waste fluid from a source to a desired collection point. Gravity drainage systems, for example, use the pull of gravity to transport waste fluid. Such systems have many drawbacks. For example, options for the layout of gravity drainage piping are limited since the piping must be located below the waste fluid source and must continuously slope toward the collection point. The waste fluid source is often located on a concrete pad, so piping must be laid out before the concrete is poured. In addition, it is overly difficult to renovate or add plumbing to a gravity drainage system due to the piping location requirements, and personnel are often displaced during renovation, resulting in loss of production time.

Vacuum drainage systems provide an alternative to conventional gravity drainage piping. Such systems typically comprise a vacuum source connected to a collection tank. A main drainage pipe is attached to the collection tank, and one or more collection branches fluidly communicate with the main drainage pipe. Each collection branch typically includes a vertical riser section having an interface valve disposed therein. A buffer for collecting waste fluid from a source is attached to a bottom end of the riser.

In operation, waste fluid initially collects in the buffer. When a fluid level is sensed in the buffer, the interface valve is opened to transfer vacuum to the buffer. The vacuum acts on a downstream side of the buffer, while an upstream side is open to atmosphere. As a result, the vacuum creates a pressure differential across the fluid in the buffer which pushes the fluid up the riser to the main drainage pipe in the form of a discrete volume or slug of waste fluid. During normal operation, the interface valve remains open for an additional period of time to pull a volume of air into the system behind the slug to ensure that the fluid is transported to the main drainage pipe. Depending on the capacity of the vacuum source, the vacuum created in the riser is capable of transporting fluid up vertical lifts, thereby allowing for greater flexibility in locating piping. As a result, vacuum drainage systems simplify installation and renovation of plumbing fixtures.

In many applications, the plumbing fixture always supplies a low volume flow of waste fluid to the buffer, so that the vacuum drainage system operates as described above. Certain plumbing fixtures, however, are capable of delivering a high flow of waste fluid which may cause the system to stall. For example, a vacuum drainage system used to collect waste fluid from a refrigerated case normally receives a low volume flow of condensate from the case. The case, however, is periodically washed, creating a high flow situation. If a wash down occurs when the system has a low vacuum level, a portion of each slug will not reach the top of the riser and will flow back into the buffer. Over time, the riser will become filled with a solid column of fluid. The vacuum source attached to the main vacuum pipe is often sized for a particular riser lift and slug size and, therefore, is often not capable of lifting the solid fluid column through the riser. As a result, the system stalls, unable to accept additional waste fluid, and waste fluid may back up through the buffer and flood the surrounding area. The only previously known solution for preventing such stalling is to select a vacuum source having a greater capacity, which is overly costly and unnecessary during normal operation. Moreover, lifting the solid fluid column up certain lifts is beyond capabilities of any type of vacuum source, and therefore the stalling problem is unresolved.

SUMMARY OF THE INVENTION

In accordance with certain aspects of the present invention, a vacuum drainage system is provided for collecting waste fluid from a source. The vacuum drainage system comprises a buffer positioned to receive waste fluid from the source, the buffer having an inlet opening and an air intake opening. A vertical riser has a lower riser section in fluid communication with the buffer and an upper riser section. A normally closed interface valve is disposed between the upper and lower riser sections and is operable to open in response to a fluid level in the buffer. A main drainage pipe is in fluid communication with the upper riser section and is maintained under vacuum. A aeration point is formed in the lower section of the riser at a height above a low point of the riser. The aeration point establishes fluid communication between an interior of the riser and atmosphere so that, when the interface valve is open, air at atmospheric pressure is pulled through the aeration point and into the lower riser section.

In accordance with additional aspects of the present invention, a vacuum drainage system is provided for collecting waste fluid from a source and comprises a main drainage pipe maintained under vacuum. A collection branch is in fluid communication with the main drainage pipe and includes a vertical riser section. An interface valve is disposed in the collection branch and divides the collection branch into an upstream riser section in fluid communication with the main drainage pipe and a downstream riser section. The interface valve is operable between a closed position, which isolates the upstream riser section from the downstream riser section, and an open position, which establishes fluid communication between the upstream and downstream sections. A buffer is in fluid communication with the upstream section of the collection branch and is positioned to receive fluid from the source, wherein the interface valve actuates to the open position in response to a fluid level in the buffer. An aeration pipe is attached to the upstream riser section at a height above a low point of the upstream riser section and establishes fluid communication between an interior of the upstream riser section and atmosphere so that, when the interface valve is in the open position, air at atmospheric pressure is pulled through the aeration point and into the upstream riser section.

In accordance with still further aspects of the present invention, aeration apparatus is provided for attachment to a riser incorporated into a vacuum drainage system. The aeration apparatus comprises a housing defining an inner chamber and having an open end adapted to fluidly communicate with an interior of the riser. A plurality of apertures extend through the housing to establish fluid communication between the inner chamber and an exterior of the housing. A blocking member is moveable along the housing to block one or more of the apertures from fluidly communicating with the open end of the housing.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1:
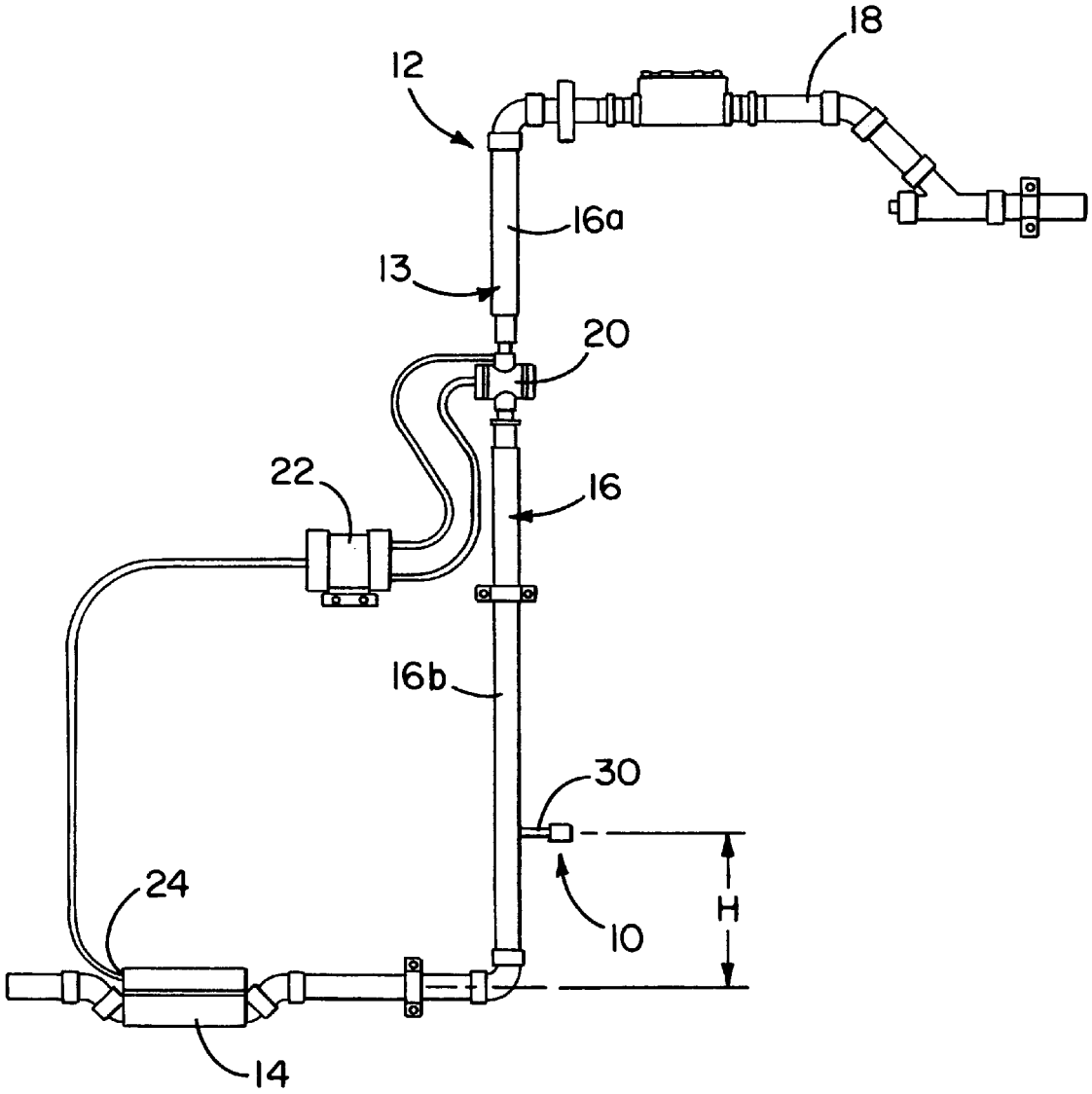
FIG. 1 is a side elevational view of a vacuum drainage system incorporating aeration apparatus in accordance with the teachings of the present invention.

Referring to FIG. 1, aeration apparatus in accordance with the present invention is indicated generally with reference numeral 10. The aeration apparatus 10 is shown incorporated in a vacuum drainage system 12. The vacuum drainage system 12 of FIG. 1 is adapted for collecting waste fluid from a low-profile fluid source, such as a refrigerated case (not shown), as described more fully below. While, for clarity of illustration, the aeration apparatus 10 is shown in FIG. 1 incorporated in a specific type of vacuum drainage system 12, persons of ordinary skill in the art will readily appreciate that the teachings of the invention are in no way limited to that system, or to any other particular environment of use. On the contrary, aeration apparatus 10 in accordance with the teachings of the present invention may be used with any type of vacuum drainage system which would benefit from the advantages the apparatus offers without departing from the scope or spirit of the invention, including, but not limited to, the vacuum drainage system 100 illustrated in FIG. 2 and described more fully below.

The vacuum drainage system 12 illustrated in FIG. 1 has a collection branch 13 which includes a buffer 14, such as a low-profile buffer box, positioned below a waste fluid source such as a refrigerated case (not shown). The buffer 14 is connected to a bottom end of a riser 16 which traverses a vertical lift. A top end of the riser 16 is attached to main drainage pipe 18 which is maintained under vacuum. The vacuum is typically supplied by a vacuum source (not shown) having an inlet in fluid communication with the main drainage pipe 18 through a collection tank (not shown). A normally-closed interface valve 20 is inserted in the riser 16 and divides the riser into an upper section 16*a* and a lower section 16*b*. An activator 22 is operatively connected to the interface valve 20 for moving the valve between open and closed positions. A sensor 24 is disposed inside the buffer 14 for indicating a high fluid level in the buffer 14, such as by measuring the pressure level of air trapped inside the buffer.

In operation, waste fluid initially collects in the buffer 14. When the buffer 14 is full, the sensor 24 triggers the activator 22 which opens the interface valve 20 to transfer the vacuum present in the main drainage pipe 18 and upper riser section 16*a* to the lower riser section 16*b* and buffer 14. During normal, low volume operation, the waste fluid is transported from the buffer 14, up the riser 16, and into the main drainage pipe 12 as a discrete slug. The interface valve 20 remains open for a sufficient time to draw in a volume of air after the slug before closing to again isolate the lower riser section 16*b* from the upper riser section 16*a*.

When the source generates a high volume of fluid waste, a solid fluid column may form in the riser 16 which stalls the vacuum drainage system 12. The high waste fluid flow may occur when the vacuum level in the system 12 is lower than normal, and therefore the pressure differential created across the slug is insufficient to transport the entire slug up the riser 16. Consequently, a portion of the slug will fall back into the riser. Successive slug portions will collect and fill the riser 16 until a solid fluid column is formed in the riser 16. If the vacuum source, when generating normal vacuum level, does not have sufficient capacity to transport the solid fluid column up the riser 16, the system 12 will stall. In this condition, the vacuum drainage system 12 will not accept additional waste fluid and the buffer 14 may overflow, flooding the immediate area with waste fluid.

Figure 3:
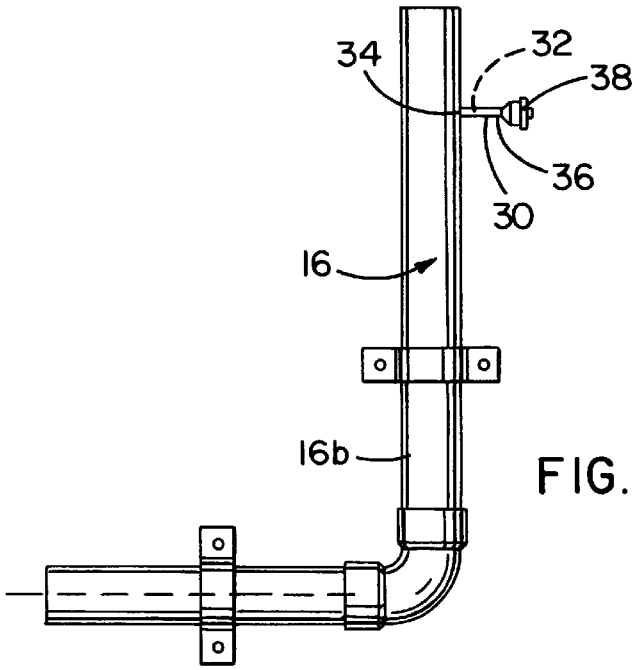
FIG. 3 is an enlarged side view of the aeration apparatus illustrated in FIGS. 1 and 2.

In accordance with certain aspects of the present invention, the riser is formed with an aeration point, such as by an aeration pipe 30 attached to the riser 16, to prevent the vacuum drainage system from stalling, as best shown in FIG. 3. The aeration pipe 30 defines an inner chamber 32 having a fixed end 34 in fluid communication with an interior of the riser 16 and a free end 36 in fluid communication with atmosphere. The aeration pipe 30 is located in the lower riser section 16*b* so that air at atmospheric pressure may enter the riser 16 through the aeration pipe 30 when the interface valve 20 is open.

In operation, the aeration pipe 30 prevents a solid water column from forming in the riser 16. The aeration pipe 30 introduces air at atmospheric pressure into the system 12 at the point at which the aeration pipe 30 intersects the riser 16. The air from the aeration pipe 30 passes through the solid water column formed in the riser 16 and separates top level portions of the column for transport under the low vacuum, thereby loosening up the slug. When the system 12 returns to normal operating conditions, the normal vacuum level is capable of transporting the remainder of the solid waste fluid column up the riser 16. As a result, the aeration pipe 30 prevents the vacuum drainage system from stalling during high flow/low vacuum conditions.

The aeration pipe 30 is preferably positioned at a vertical height H above a low point of the riser 16, to optimize solid fluid column break-up. It will be appreciated that when the aeration pipe 30 is attached at too high of a point along the riser 16, the aeration pipe 30 is less effective at breaking up the solid fluid column since the fluid in the riser 16 below the aeration pipe 30 is unaffected. On the other hand, if placed too low, the pressure created by the standing fluid column will equal or exceed atmospheric pressure, and therefore no pressure differential exists to pull air into the riser 16 through the aeration pipe 30. The optimum position of the aeration pipe 30 is also affected by the length of the riser 16. For example, when the riser 16 has a vertical height of 22 feet, it has been determined that the aeration pipe 30 is most preferably located approximately 2–3 feet above the low point of the riser 16. While the aeration pipe 30 may still be effective when located at a height outside of this range, the efficiency of the pipe 30 is reduced.

In the preferred embodiment, the aeration pipe 30 is modified to prevent discharge of waste fluid during operation of the vacuum drainage system 12. As best shown in FIG. 3, a check valve 38 is attached to the free end 36 of the aeration pipe 30 which allows air flow into the pipe 30 but prevents fluid from flowing out of the pipe 30. In the alternative, an elbow (not shown) and an upwardly extending vertical pipe may be attached to the aeration pipe 30 to retain the waste fluid.

Figure 2:
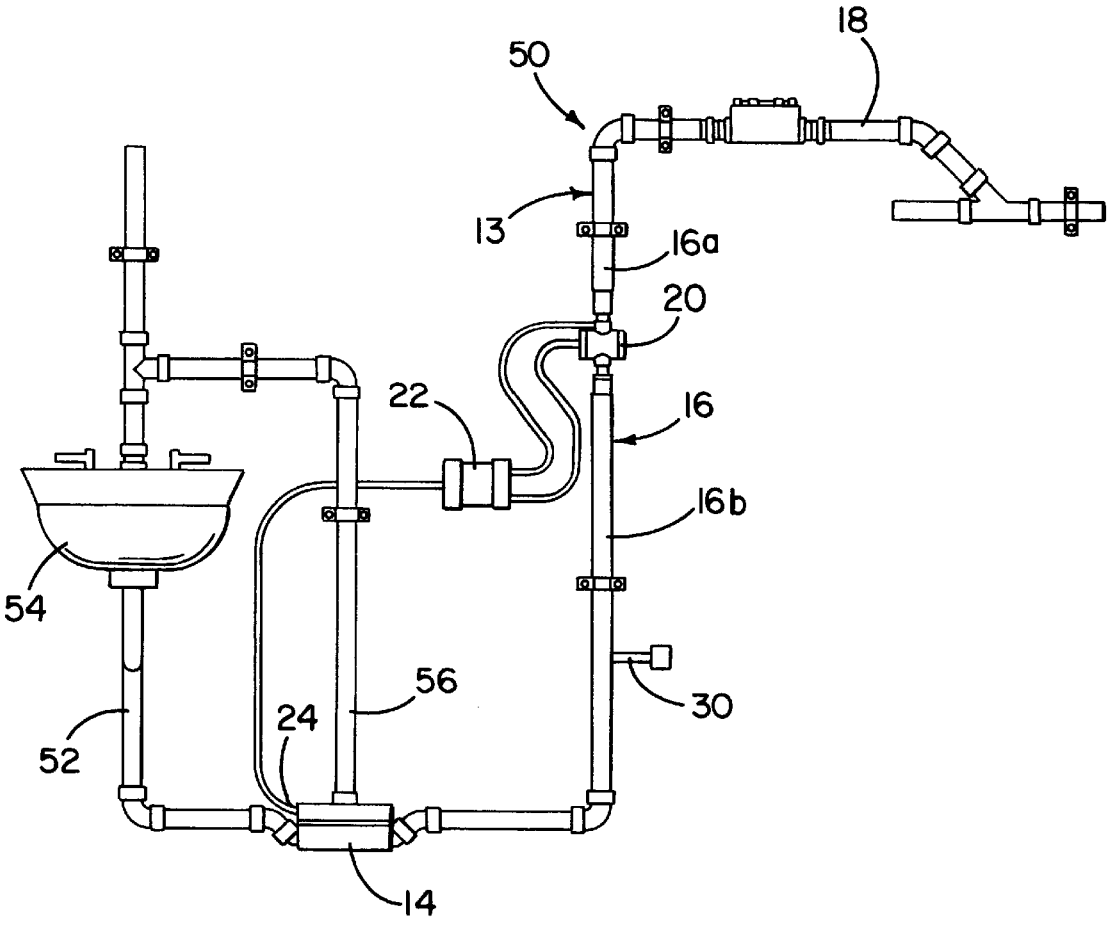
FIG. 2 is a side elevational view of another vacuum drainage system incorporating aeration apparatus in accordance with the teachings of the present invention.

The aeration pipe 30 may also be incorporated in a different type of vacuum drainage system to allow efficient operation with a deliberately flooded riser. The vacuum drainage system 50 of FIG. 2 is similar to the system 10 illustrated in FIG. 1, and the same reference numerals are used to identify the same components. Accordingly, the vacuum drainage system 50 includes a main drainage pipe 18 maintained under negative pressure, a riser 16 having upper and lower sections 16*a,* 16*b,* a buffer 14 attached to the lower riser section 16*b,* and an interface valve 20. An activator 22 is operably connected to the interface valve 20, and a sensor 24 is disposed in the buffer 14 and coupled to the activator 22. As a result, the vacuum drainage system 50 operates in a similar manner to the vacuum drainage system 10.

In the present embodiment, however, an inlet pipe 52 having a vertically extending section connects the buffer 14 to an elevated plumbing fixture, such as a sink 54. As a result, the buffer 14 does not have an air intake open directly to atmosphere, but instead has a vertically extending air intake pipe 56 attached to the air intake of the buffer 14 to prevent discharge of waste fluid through the air intake of the buffer 14.

The sink 54 normally produces a low volume of waste fluid which is efficiently transported by the vacuum drainage system 50. For example, a faucet of the sink 54 typically has a maximum flow rate of about 2.2 gallons per minute. The sink 54, however, may generate high flow conditions, such as when the entire volume of the sink 54 is drained at once. In a high flow situation, the waste fluid may back up in the inlet pipe 52 and air intake pipe 56. The backed-up fluid generates a pressure level in the buffer 14 which causes the activator 22 to remain constantly open. As a result, the system 50 attempts to transport one continuous slug up the riser 16. Most vacuum sources are unable to transport such a volume up the riser 16, and therefore the riser 16 fills with a solid column of waste fluid.

In this embodiment, the aeration pipe 30 is provided in the vacuum drainage system 50 to allow operation with a flooded riser 16. The aeration pipe 30 is attached to the riser 16 to allow air at atmospheric pressure to enter the riser 16. Similar to the previous embodiment, air entering the riser 16 through the aeration pipe 30 breaks up the solid fluid column to allow fluid to be transported up the riser 16.

In addition, the aeration pipe 30 is sized to regulate the flow of air into the riser 16. The inner chamber 32 of the aeration pipe 30 has a cross-sectional area through which atmospheric air passes into the riser 16. The cross-sectional area may sized to obtain a desired volume of flow, taking into account the vacuum level generated in the vacuum drainage system 50. For example, when the aeration pipe 30 is round, it has been found that an inside diameter of approximately 0.18 inches is desired, which is typically smaller than the air intake opening in the buffer 14. By limiting the volume of air, the system 50 operates efficiently in the flooded condition. As a result, the vacuum drainage system 50 of the present embodiment operates in a deliberately flooded condition to transport a continuous flow of waste fluid up the riser 16 to the main drainage pipe 18.

Figure 4A:
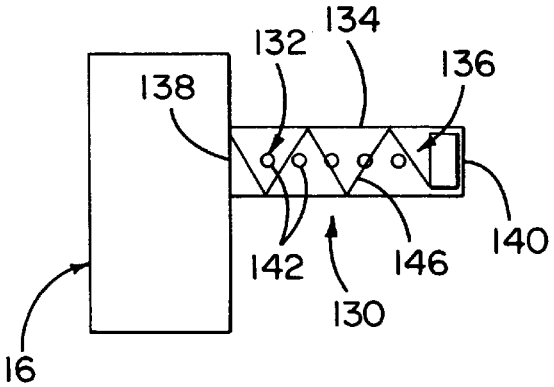
FIG. 4A is a side elevational view of an alternative embodiment of aeration apparatus in accordance with the teachings of the present invention, the aeration apparatus being in a fully open position.
Figure 4B:
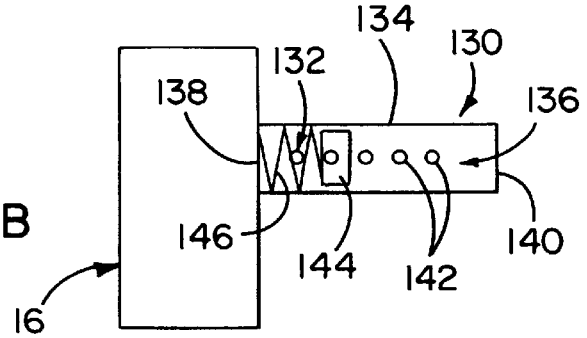
FIG. 4B is a side elevational view of the aeration apparatus of FIG. 4A in a closed position.

In accordance with additional aspects of the present invention, adjustable aeration apparatus 130 is provided which alters the size of an aeration inlet 132 according to the vacuum level in the riser 16. As best illustrated in FIGS. 4A and 4B, the adjustable aeration apparatus 130 includes housing 134 attached to the riser 16. The housing 134 defines an inner chamber 136 and has an open end 138 adapted to fluidly communicate with an interior of the riser 16 and a closed end 140. The aeration inlet 132 is formed by a plurality of apertures 142 extending through and disposed along an axial length of the housing 134. The apertures 142 establish fluid communication between the inner chamber 136 and an exterior of the housing 134.

A blocking member, such as a piston 144, is disposed inside the inner chamber 136 and is moveable along the axial length of the housing 134 to selectively block one or more of the apertures 142 from fluidly communicating with the open end 138 of the housing 134. For example, as illustrated in FIG. 4A, the piston 144 is positioned near the closed end 140 of the housing 134 so that all five apertures 142 allow air to flow into the riser 16. In FIG. 4B, the piston 144 is positioned near the open end 138 of the housing 134 so that only the left-most aperture 142 allows air into the riser 16.

In the preferred embodiment, the aeration apparatus 130 is self-adjusting to alter the size of the aeration inlet 132. As illustrated in FIGS. 4A and 4B, a spring 146 is attached to the piston 144 for biasing the piston 144 toward the closed end 140 of the housing 134. The spring 146 is selected so that it compresses when vacuum present in the inner chamber 136 of the housing 134 pulls the piston 144 toward the open end 138. The distance the piston 144 moves is related to the magnitude of the vacuum. Accordingly, when a high vacuum level is present in the inner chamber 132, the piston 144 is pulled against the force of the spring 146 toward the open end 138, thereby blocking several of the apertures 142 and reducing the cross-sectional area of the aeration inlet 132 (FIG. 4B). During low or no vacuum conditions, the piston 144 is pushed by the spring 146 toward the closed end 140, thereby allowing more apertures 142 to communicate with the open end 138 and increasing the cross-sectional area of the aeration inlet 132 (FIG. 4A). As a result, the aeration apparatus 130 automatically adjusts according to vacuum level in the inner chamber 136. It will be appreciated, however, that other mechanisms, such as an actuator coupled to a controller and a sensor for measuring vacuum level in the inner chamber 136, may be used to adjust the piston 144 according to operating parameters in the vacuum drainage system.

In light of the above, it will be appreciated that the present invention brings to the art a new and improved vacuum drainage system having a vertical riser with an aeration point. The aeration point prevents stalls in the vacuum drainage system by breaking up the formation of a solid fluid column in the riser. In certain applications, the aeration point allows the vacuum drainage system to operate in a deliberately flooded condition by regulating air flow into the riser. The aeration point may be provided simply as a hole positioned at an optimum height above a bottom of the riser, or it may include apparatus for retaining fluid inside the riser, such as a check valve. In addition, the aeration point may be provided with an automatically adjustable cross-section, so that the aeration point is quickly and easily adapted to changing operating parameters in the vacuum drainage system.

What is claimed is:

1. A vacuum drainage system for collecting waste fluid from a source, the vacuum drainage system comprising:

a buffer positioned to receive waste fluid from the source, the buffer having an inlet opening and an air intake opening;

a vertical riser having a lower riser section in fluid communication with the buffer and an upper riser section;

a normally closed interface valve disposed between the upper and lower riser sections, the interface valve operable to open in response to a fluid level in the buffer;

a main drainage pipe in fluid communication with the upper riser section, the main drainage pipe being maintained under vacuum; and an aeration point formed in the lower section of the riser at a height above a low point of the riser, the aeration point establishing fluid communication between an interior of the riser and atmosphere so that, when the interface valve is open, air at atmospheric pressure is pulled through the aeration point and into the lower riser section.

2. The vacuum drainage system of claim 1, in which the aeration point is formed by an aeration pipe having a fixed end intersecting the riser and a free end, the aeration pipe defining an inner chamber in fluid communication with the interior of the riser.

3. The vacuum drainage system of claim 2, further comprising a check valve attached to the free end of the aeration pipe.

4. The vacuum drainage system of claim 1, in which the riser is approximately 22 feet long, and height of the aeration point is approximately 2–3 feet above the low point of the riser.

5. The vacuum drainage system of claim 1, further comprising an air intake pipe having a vertically extending section attached to the air intake opening of the buffer, and an inlet pipe having a vertically extending section attached to the inlet opening of the buffer.

6. The vacuum drainage system of claim 5, in which the source comprises a sink having a drain, and in which the inlet pipe is adapted to fluidly communicate with the drain.

7. The vacuum drainage system of claim 6, in which the waste fluid reaches the vertically extending section of the air intake pipe and the vertically extending section of the inlet pipe so that the interface valve is continuously open.

8. A vacuum drainage system for collecting waste fluid from a source, the vacuum drainage system comprising:

a main drainage pipe maintained under vacuum;

a collection branch in fluid communication with the main drainage pipe, the collection branch including a vertical riser section;

an interface valve disposed in the collection branch and dividing the collection branch into an upstream riser section in fluid communication with the main drainage pipe and a downstream riser section, the interface valve operable between a closed position, which isolates the upstream riser section from the downstream riser section, and an open position, which establishes fluid communication between the upstream and downstream sections;

a buffer in fluid communication with the upstream section of the collection branch and positioned to receive fluid from the source, wherein the interface valve actuates to the open position in response to a fluid level in the buffer; and an aeration pipe attached to the upstream riser section at a height above a low point of the upstream riser section, the aeration pipe establishing fluid communication between an interior of the upstream riser section and atmosphere so that, when the interface valve is in the open position, air at atmospheric pressure is pulled through the aeration pipe and into the upstream riser section.

9. The vacuum drainage system of claim 8, further comprising a check valve attached to the free end of the aeration pipe.

10. The vacuum drainage system of claim 8, in which the upstream and downstream riser sections span a vertical height of approximately 22 feet, and the height of the aeration point is approximately 2–3 above the low point of the riser.

11. The vacuum drainage system of claim 8, further comprising an air intake pipe having a vertically extending section attached to an air intake opening of the buffer, and an inlet pipe having a vertically extending section attached to an inlet opening of the buffer.

12. The vacuum drainage system of claim 11, in which the source comprises a sink having a drain, and in which the inlet pipe is adapted to fluidly communicate with the drain.

13. The vacuum drainage system of claim 12, in which the waste fluid reaches the vertically extending section of the air intake pipe and the vertically extending section of the inlet pipe so that the interface valve is continuously open.

* * * * *